US005125399A

United States Patent [19]

Tarjoto

[11] Patent Number: 5,125,399

[45] Date of Patent: Jun. 30, 1992

[54] PERSONAL CUDDLING AND MASSAGING DEVICE

[76] Inventor: Heru K. Tarjoto, P.O. Box 329 Denpasar, Bali, Indonesia

[21] Appl. No.: 710,019

[22] Filed: Jun. 4, 1991

[51] Int. Cl.[5] ..... A61H 1/00

[52] U.S. Cl. ..... 128/32; 128/45; 128/24 R

[58] Field of Search ..... 128/32, 35, 36, 24 R, 128/24.1, 24.2, 43, 33, 45; 446/337, 362, 368, 278; 5/434, 36

[56] References Cited

U.S. PATENT DOCUMENTS

| | | | |
|---|---|---|---|
| 1,049,345 | 1/1913 | Dolman | 446/368 |
| 2,859,731 | 6/1957 | Sutton | 128/24.1 |
| 3,948,379 | 4/1976 | Warner | 128/33 |
| 4,465,158 | 8/1984 | Yamazaki | 128/33 |
| 4,941,478 | 7/1990 | Takeuchi | 5/437 |

FOREIGN PATENT DOCUMENTS

| | | | |
|---|---|---|---|
| 17667 | of 1909 | United Kingdom | 446/278 |
| 387199 | 2/1933 | United Kingdom | 446/361 |

*Primary Examiner*—Mickey Yu
*Assistant Examiner*—David J. Kenealy
*Attorney, Agent, or Firm*—Donald A. Kettlestrings

[57] ABSTRACT

A personal cuddling and massaging device is provided which allows encyclopedic use of the device for cuddling and/or as a plaything as well as for massaging an area of the body of a person cuddling it. A power-driven massaging system is provided inside the device. The external shape of the device can be made to hump or arch and the relative speed of the humping or arching may be adjusted by adjusting the motion speed of the power-driven system to give the desired massaging affect on contact of the device with an area of the body of a person while cuddling or embracing it.

12 Claims, 4 Drawing Sheets

PERSONAL CUDDLING AND MASSAGING DEVICE

BACKGROUND OF THE INVENTION

This invention relates to the field of body massaging devices and, more specifically, to a portable body massaging device which is unique in its unified intrinsic function and sculptured form. The device can be used as a cuddling cushion and/or as a plaything, and it can be used to massage an area of the body of a person cuddling it.

Numerous portable massaging devices are known that are especially designed and adapted to various purposes. While these units may be suitable for the particular purpose which they address, they are not suitable for the special purposes of the present invention, as hereafter described.

SUMMARY OF THE INVENTION

The primary objective of the present invention is to provide a personal cuddling and massaging system which allows a user to embrace the artifice as a plaything and to use the artifice as a stroking device for massaging an area of the user's body while the user is cuddling or embracing it.

Another object is to provide a personal cuddling cushion, which will be unique in its structural design, in that its unique sculptured form may be maintained and proportionally made in various sizes, and may be used as a cuddling plaything or doll-like figurine and the like for baby, toddler, children, youngster, teenager or adult.

Another object is to provide a personal cuddling cushion which will be made with a power-driven massaging system embodied inside the artifice, so it may be used as a cuddling plaything and it may be used for massaging an area of the user's body while the user is cuddling or using it.

Another object is to provide a personal cuddling cushion, which will be made with a power-driven massaging system embodied inside the artifice to enable the relative external shape of the artifice to hump or arch.

Another object is to provide a personal cuddling cushion, which will be made with a power-driven massaging system embodied inside the artifice, and the relative intensity of the humping or arching motion may be easily adjusted to provide the desired massaging affect on an area of the user's body while the user is cuddling or using the cushion.

Another object is to provide a personal cuddling cushion, which will be made with a power-driven massaging system embodied inside the artifice, and which is provided with a unique sculptured form that is contoured in such a way and is especially provided for and/or adaptable for an additional strapped-on type accessory which may be attached onto the cushion to provide further massaging affect on a special area of the user's body while the user is cuddling or embracing the cushion.

Another object is to provide a personal cuddling cushion, which will be made with a power-driven massaging system embodied inside the artifice, and wherein the unit as a whole is portable, lightweight, and can be easily tossed and rolled around and/or used in any position.

An additional object is to provide a personal cuddling cushion, which will be made with a power-driven massaging system embodied inside the artifice, and wherein the power drive system may be operated by an internal battery type self-contained power source or an external power source.

A further object is to provide a personal cuddling cushion, which will be made with a power-driven massaging system embodied inside the artifice, and wherein the cushion is soft to touch, comfortable and easy to use.

A still further object is to provide a cuddling cushion, which will be made with a power-driven massaging system embodied inside the artifice, and wherein the combination is suited for mass production, is simple to make and economical in cost to manufacture.

Further objects of the invention will appear as the description proceeds.

To accomplish the above and related objects, this invention may be embodied in the form illustrated in the accompanying drawings, which illustrate an example of a preferred embodiment of the invention, attention being called to the fact, however, that the drawings are illustrative only and that changes may be made in the specific construction illustrated and described within the scope of the appended claims.

BRIEF DESCRIPTION OF THE DRAWING FIGURES

The figures in the drawing are briefly described as follows.

DETAILED DESCRIPTION OF THE PREFERRED EMBODIMENTS

Figure 1:
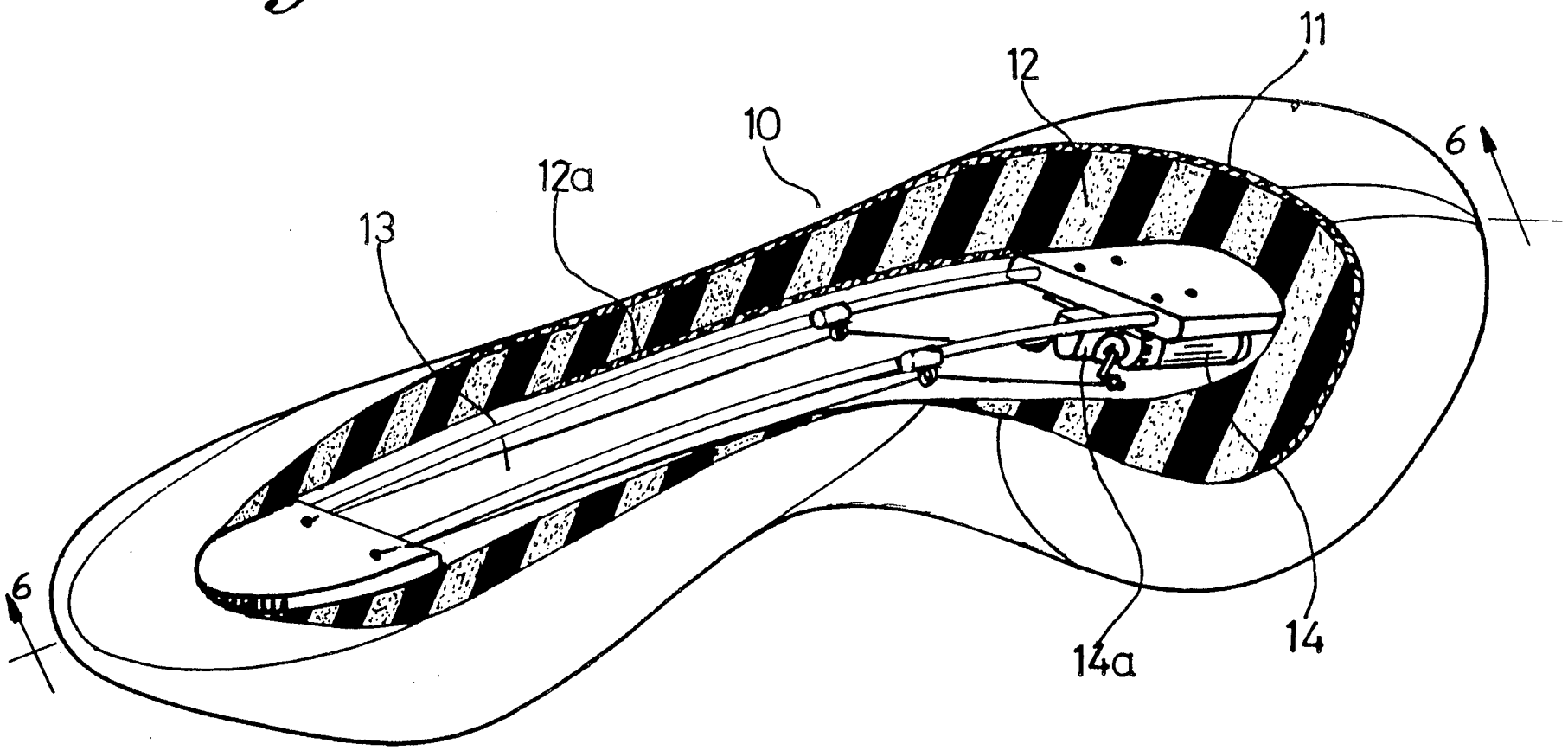
FIG. 1 is a fragmentary perspective view of the personal cuddling and massaging device and diagrammatically illustrates the power-driven massaging system embodied inside the artifice.
Figure 2:
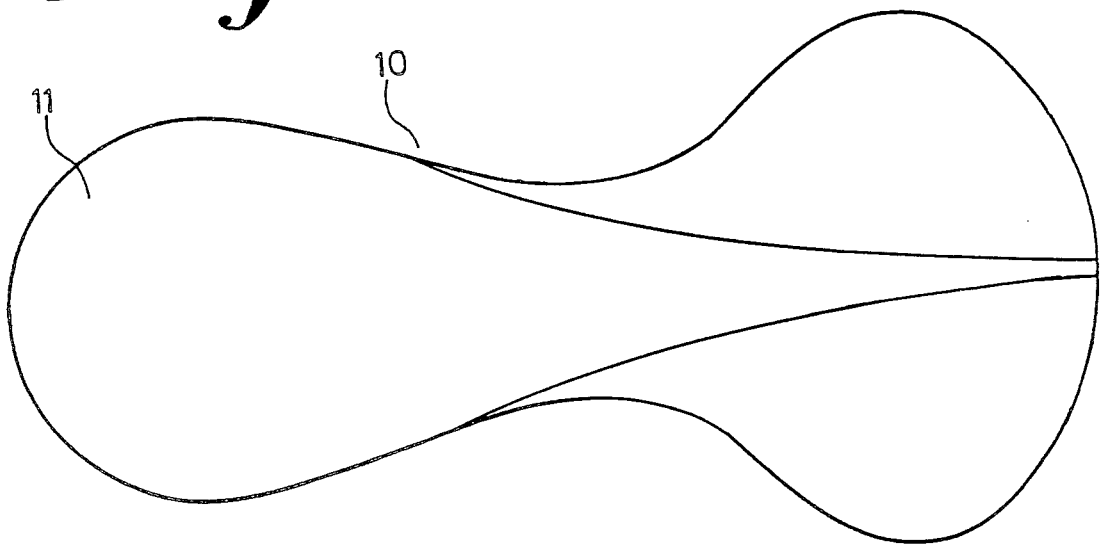
FIG. 2 is a top elevational view of the device shown in FIG. 1 and illustrates the external sculptured form of the artifice.
Figure 3:
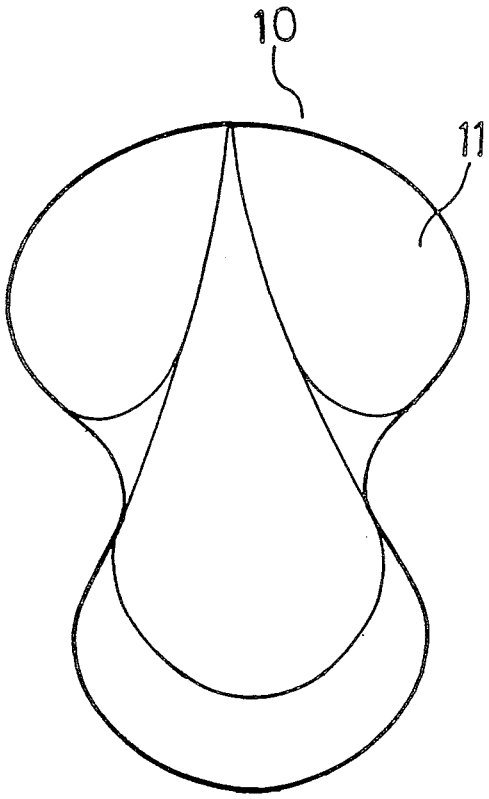
FIG. 3 is a front elevational view of the device shown in FIG. 1 and illustrates the external sculptured form of the artifice.
Figure 4:
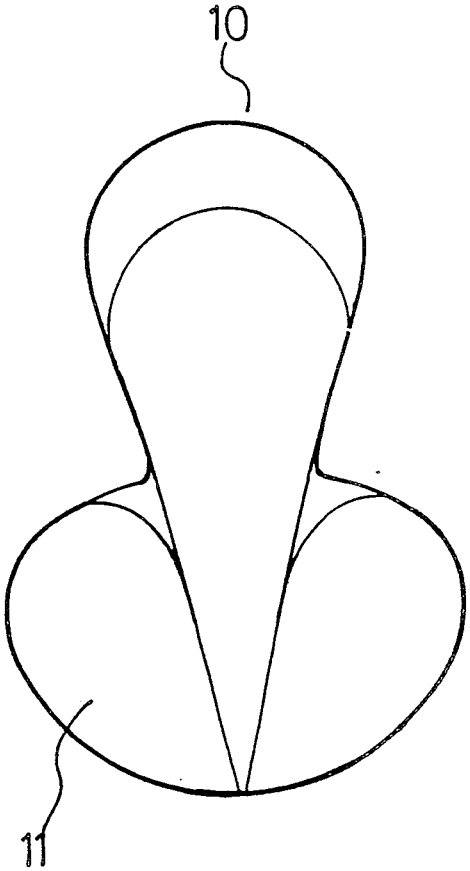
FIG. 4 is a rear elevational view of the device and illustrates the external sculptured form of the artifice.
Figure 5:
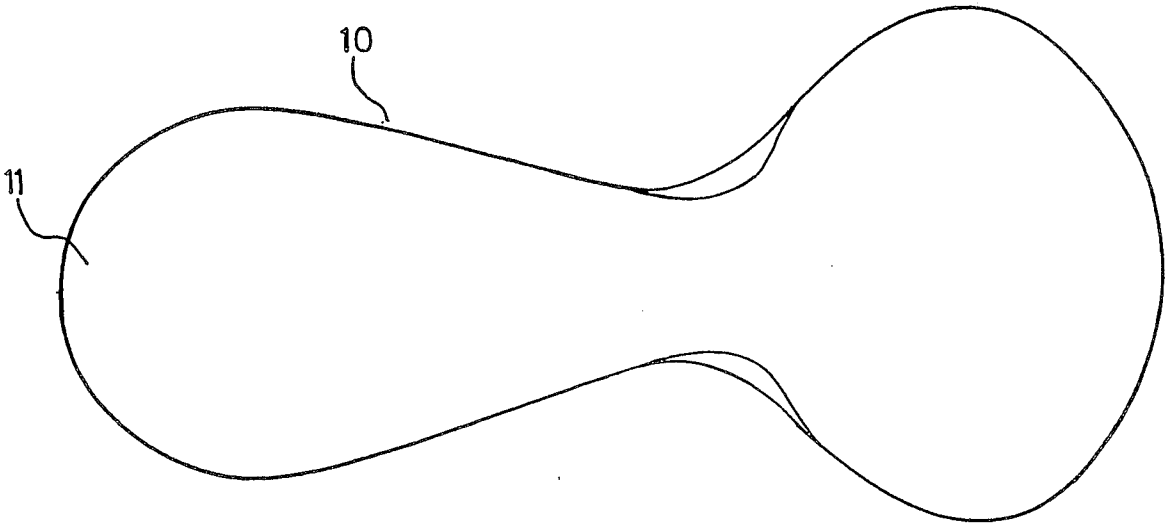
FIG. 5 is a bottom elevational view of the device and illustrates the external sculptured form of the artifice.

With reference to the drawings, in which like reference characters denote like elements throughout the same, the invention may be esthetically designed in the form of a sculptured-shaped cushion 10. An outermost laminated covering 11, preferably fabricated of a non-allergenic, flexible, impermeable lamination of sewable fabric, fits and encapsulates a cushion filling 12, preferably fabricated of a soft and non-flammable material, which acts as a cushion. A protective shield 12*a*, preferably made of stretchable material, encapsulates a power-driven massaging system 13.

Figure 6:
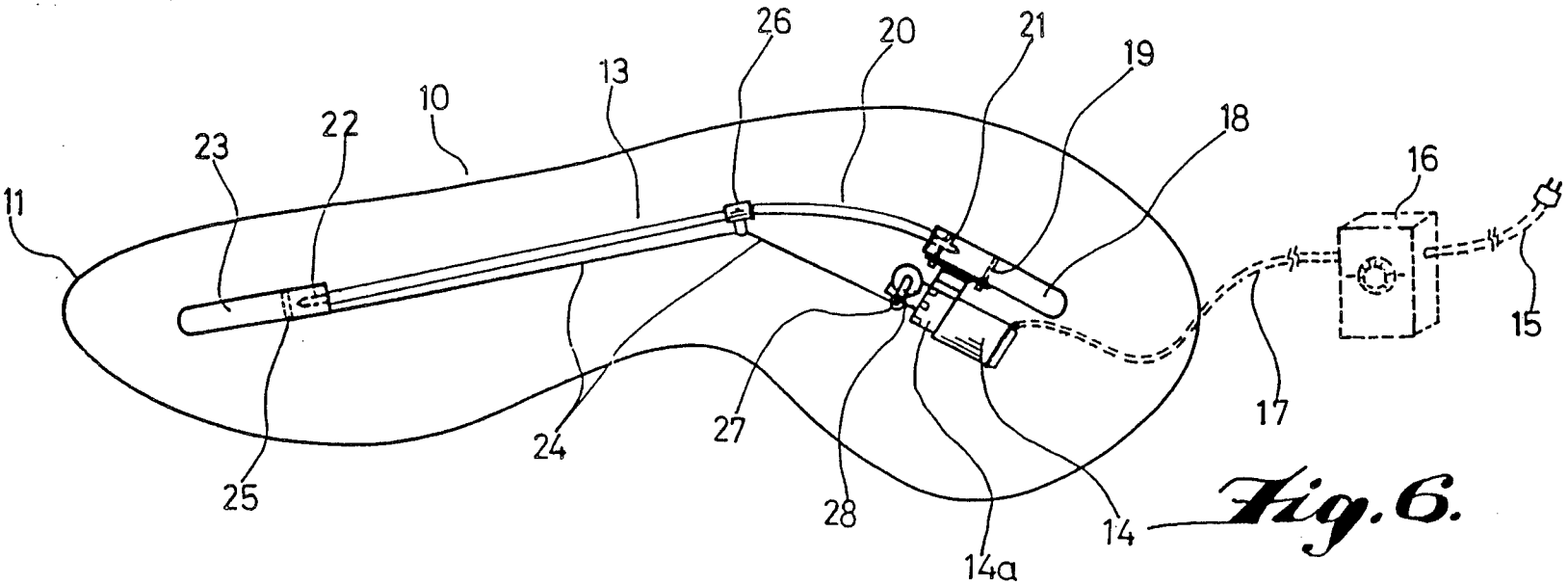
FIG. 6 is a right-side sectional view of the device taken substantially along the line 6—6 in FIG. 1 and looking in the direction of the arrows and diagrammatically illustrates a side-view of the power-driven massaging system.
Figure 7:
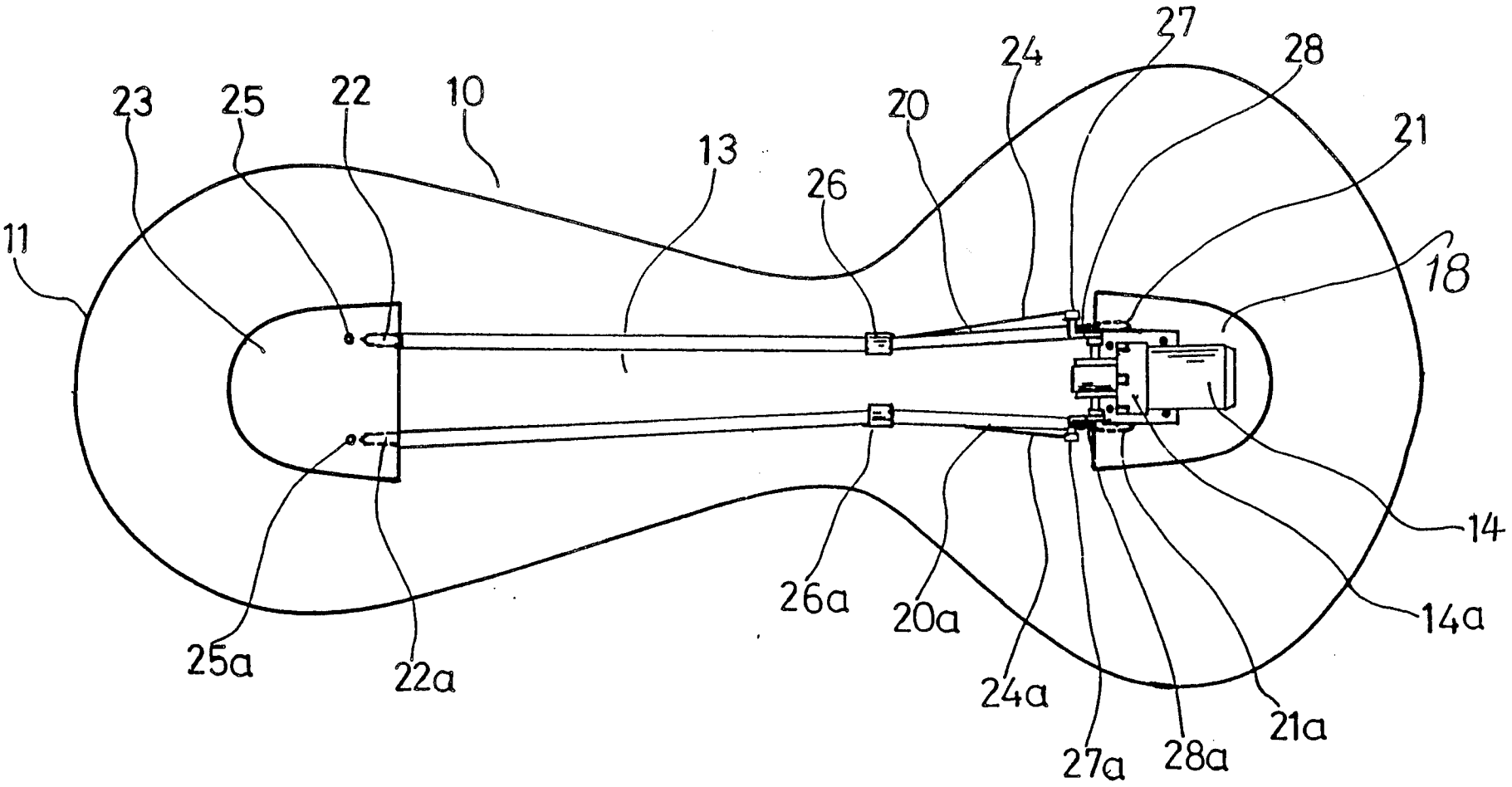
FIG. 7 is a bottom fragmentary view of the device diagrammatically illustrating the power-driven massaging system.

The detailed mechanism of power-driven massaging system 13 may be understood with reference to FIGS. 6 and 7. Power-driven system 13 comprises an adjustable speed motor 14, and (as shown for illustration) an external power cable 15 is provided as an external electrical power source input for the motor's adjustable speed drivers 16. Input power cable 17 is connected to adjustable speed motor 14, and incorporated as a unit of motor 14 is a right-angle gear drive 14*a*, which is fastened with base screws 19 onto rear base frame 18. A pair of gradually tapered cylindrical rods 20 and 20*a*, preferably made of fiber composite material, is press-fitted into tapered holes 21 and 21*a* of a rear base frame 18, and the other ends of the gradually tapered cylindrical rods 20 and 20*a*, preferably the larger ends are press-fitted into tapered holes 22 and 22*a* of the front base frame 23. Ends of nylon-covered flexible steel cables 24 and 24*a* are fastened onto holes 25 and 25*a*, respectively, of front base frame 23. The other ends of steel cables 24 and 24*a* are attached onto bearing sleeves 27 and 27*a*, respectively, of rotating arms 28 and 28*a* via cable guide eyelets 26 and 26*a*, which are fastened onto the periphery of cylindrical rods 20 and 20*a*.

The detailed operation of the power-driven massaging unit 13 may be understood with reference to FIGS. 6 and 7. When motor 14 is energized, arms 28 and 28*a* of right-angle gear box 14*a* rotate in synchronized circular motion and pull steel cables 24 and 24*a* simultaneously, thereby pulling front base 23 and rear base frame 18 together to form a hump or arch along the entire length of the sculptured form cushion 10.

In operative use it is to be noted that cylindrical rods 20 and 20*a* act as return springs as rotating arms 28 and 28*a* complete their rotating cycles. The speed of the humping or arching motion of cushion 10 may be adjusted by adjusting the rotating speed of motor 14, and the extent of the longitudinal hump or arch along cushion 10 may be increased by lengthening the swing radius of rotating arms 28 and 28*a*.

In non-operative use it is to be noted that the extent of the hump or arch along cushion 10 may be adjusted by shifting the positions of cable guide eyelets 26 and 26*a* along the periphery of cylindrical rods 20 and 20*a*, or by adjusting the rotational position of rotating arms 28 and 28*a*, or by adjusting the length of steel cables 24 and 24*a*, or by adjusting a combination of these elements.

While certain novel features of this invention have been shown and understood and/or pointed out in the annexed claims, it will be understood that certain omissions, substitutions and changes in the form and details of the device illustrated and in its operation can be made by those skilled in the art without departing from the concept of the invention.

What is claimed is:

1. A cuddling and massaging device comprising:

an artifice of predetermined shape;

an electrically-powered massaging system located within said artifice for varying the external shape of said artifice, said massaging system comprising a front supporting frame and a rear base supporting frame;

a pair of spring-like flexible and gradually tapered cylindrical rods interconnecting said frames; and means in operative relationship with said artifice and with said massaging system for controlling the amount of variation of the external shape of said artifice and the rate of change of said external shape.

2. A cuddling and massaging device, as in claim 1, wherein said tapered cylindrical rods each comprise cable guide eyelets fastened onto the periphery of the cylindrical rods.

3. A cuddling and massaging device, as in claim 2, wherein said cable guide eyelets provide adjustment for longitudinal flexing of said cylindrical rods and the hump or arch of said artifice.

4. A cuddling and massaging device as in claim 1 wherein said artifice includes an outermost covering, a cushion filling material and a protective shield encapsulating said massaging system.

5. A cuddling and massaging device as in claim 1 wherein said artifice and said massaging system function as one unit to create a humping or arching motion of said artifice.

6. A cuddling and massaging device as in claim 1 wherein said massaging system comprises an adjustable speed electrical motor.

7. A cuddling and massaging device as in claim 1 wherein said artifice is for use primarily for cuddling and massaging an area of a body of a person while the person is cuddling or embracing the device.

8. A cuddling and massaging device comprising:

an artifice of predetermined shape;

an electrically-powered massaging system located within said artifice for varying the external shape of said article, said massaging system comprising a front supporting frame and a rear base supporting frame;

said rear base frame comprising an adjustable speed motor and right-angle gear drive incorporated as one unit, said right-angle gear drive comprising rotating arms and bearing sleeves connected to said rotating arms, wherein said sleeves each comprise a cable fastened onto said front base frame; and means in operative relationship with said artifice and with said massaging system for controlling the amount of variation of the external shape of said artifice and the rate of change of said external shape.

9. A cuddling and massaging device for use primarily for cuddling and massaging an are of a body of a person while the person is cuddling or embracing the device, said device comprising:

a portable artifice of predetermined shape and defining an imaginary plane of symmetry along the entire length of said artifice;

electrically-powered means located within said artifice for creating a humping or arching motion substantially along the entire length of said artifice and substantially along said plane of symmetry;

means in operative relationship with said electrically-powered means for changing the speed and the extent of said humping or arching motion; and said electrically-powered means including a front supporting frame and a rear supporting frame and a pair of spring-like, flexible and gradually tapered cylindrical rods interconnecting said frames.

10. A cuddling and massaging device, as in claim 9 wherein said rear frame comprises an adjustable speed motor and right-angle gear drive incorporated as one unit.

11. A cuddling and massaging device as in claim 10 wherein said right-angle gear drive comprises rotating arms and bearing sleeves connected to said rotating arms and wherein said device further includes steel cables fastened to said front frame and to said bearing sleeves.

12. A cuddling and massaging device as in claim 9 further including cable guide eyelets adjustably fastened onto the periphery of each of said tapered cylindrical rods, wherein said cable guide eyelets provide adjustment for longitudinal flexing of said tapered cylindrical rods and the extent of the longitudinal hump or arch of said artifice.

* * * * *